US008840050B2

(12) United States Patent
Baumann et al.

(10) Patent No.: US 8,840,050 B2
(45) Date of Patent: Sep. 23, 2014

(54) POTENTIAL NEUTRALIZATION ARRANGEMENT FOR AN ELECTROSTATIC ROTARY ATOMIZER

(75) Inventors: Michael Baumann, Weinbergsteige (DE); Frank Herre, Oberriexingen (DE); Hans J. Nolte, Stuttgart (DE); Harry Krumma, Bönnigheim (DE); Stefano Giuliano, Gerlingen (DE); Björn Lind, Gothenburg (SE)

(73) Assignee: Durr Systems, Inc., Bietigheim-Bissingen (DE)

( * ) Notice: Subject to any disclaimer, the term of this patent is extended or adjusted under 35 U.S.C. 154(b) by 1280 days.

(21) Appl. No.: 11/385,335

(22) Filed: Mar. 21, 2006

(65) Prior Publication Data

US 2006/0157597 A1 Jul. 20, 2006

Related U.S. Application Data

(63) Continuation of application No. 10/624,259, filed on Jul. 22, 2003, now abandoned.

(30) Foreign Application Priority Data

Jul. 23, 2002 (DE) ..... 102 33 197

(51) Int. Cl.
*B05B 5/00* (2006.01)

(52) U.S. Cl.
USPC ..... 239/700; 239/706

(58) Field of Classification Search
CPC .... B05B 5/1691; B05B 5/047; B05B 5/0403; B05B 1/306; B05B 5/0407; B05B 5/032
USPC ..... 239/690, 692, 694, 699, 700–703, 706; 439/181
See application file for complete search history.

(56) References Cited

U.S. PATENT DOCUMENTS

| | | | | |
|---|---|---|---|---|
| 4,286,180 | A * | 8/1981 | Langley | 310/12.27 |
| 4,368,853 | A * | 1/1983 | Morishita et al. | 239/703 |
| 4,398,672 | A | 8/1983 | Arnold et al. | |
| 6,202,945 | B1 * | 3/2001 | Yasuda et al. | 239/704 |

FOREIGN PATENT DOCUMENTS

| | | | |
|---|---|---|---|
| EP | 0120648 | A2 | 10/1984 |
| EP | 0796663 | A2 | 9/1997 |
| EP | 0801991 | A2 | 10/1997 |
| EP | 1118388 | A1 | 7/2001 |

* cited by examiner

*Primary Examiner* — Christopher Kim
(74) *Attorney, Agent, or Firm* — Bejin VanOphem & Bieneman PLC

(57) ABSTRACT

For grounding or electrically charging the shaft of an electrostatic rotary atomizer working with external or direct charging, there are opposing, annular or spiral-shaped sharp edges in the outer surface of a part of the shaft and in the inner surface of a stationary bearing part at the desired potential, which have different, preferably opposite, thread directions, so that the edges intersect each other at points.

17 Claims, 1 Drawing Sheet

POTENTIAL NEUTRALIZATION ARRANGEMENT FOR AN ELECTROSTATIC ROTARY ATOMIZER

RELATED APPLICATIONS

This is a continuation patent application that claims priority to a patent application Ser. No. 10/624,259, filed on Jul. 22, 2003 now abandoned and incorporated herewith by the reference in its entirety.

FIELD OF THE INVENTION

The invention concerns a potential neutralization arrangement for an electrostatic rotary atomizer.

BACKGROUND OF THE INVENTION

The invention deals with, for example, high-speed rotary atomizers suitable for the electrostatic mass-production coating of work pieces, such as vehicle chassis, with electrodes, which are used for external charging of the coating material and which in operation are at a high voltage on the order of magnitude of 100 kV, while the bell-shaped plate in the area of the electrode field should be at a defined potential, usually ground potential (EP 0 796 663 B1). However, it can also concern rotary atomizers with components, such as, e.g., the bell-shaped plate, which are charged to a high voltage (EP 0 801 991 A2).

Radial turbines, which are driven by compressed air in a known way and which have a hollow shaft that carries the bell-shaped plate and that rotates without contact in air bearings, are used for driving the bell-shaped plate of such atomizers. For potential neutralization between the hollow shaft with the bell-shaped plate affected by the high-voltage field and a grounded part of the bearing unit of the shaft, the atomizer known from EP 0 796 663 B1 uses a stationary contact ring with carbon-fiber bristles that slide on the rotating shaft to produce an electrically conductive connection. Here, one disadvantage is the wear caused by the mechanical contact. In addition, in practice a contact ring removed to perform maintenance on the bearing unit might not be installed again inadvertently. The results are incorrect potential neutralization and damage to the bearing unit due to spark erosion.

For contact-free grounding of the shaft of an electrostatic rotary atomizer, it is known from EP 1 118 388 A1 to arrange a grounded, adjustable screw in the bearing housing, whose tip faces a peripheral surface of the shaft. This arrangement does not satisfactorily solve the stated problem, because the point discharge at the screw tip leads to deterioration due to spark erosion. Manual adjustment of the screw, which is used to compensate for erosion, is not only troublesome and time-consuming, but also too imprecise for a defined potential neutralization.

SUMMARY OF THE INVENTION

A stationary needle electrode, which transfers its charge through corona discharge to the surface of the hollow shaft, is used for charging the bell-shaped plate of the atomizer known from EP 0 801 991 A2.

The invention is based on the problem of providing an arrangement that guarantees long-term, reliable potential neutralization, which is not endangered by maintenance errors, between the shaft and the bearing unit of an electrostatic rotary atomizer.

This problem is solved by the potential neutralization arrangement characterized in the claims.

Here, the potential neutralization can be performed free from wear and tear, and more simply than before, because the invention manages without the contact ring used previously as an additional component as well as without an electrode to be adjusted manually. The transfer of electrical charge can be implemented solely by means of the special surface structure with sharp elements between the shaft and the part of the bearing unit supplying the desired potential. The sharp elements consist of, e.g., edges running like a thread around the outer surface of the shaft part and/or around the inner surface of the support part, so that the sharp elements do not lead to wear and tear due to undesired spark erosion, which is typical for point discharges.

According to one refinement of the invention, if opposing threads formed in the outer surface of the shaft part and in the inner surface of the bearing part have different and preferably opposite thread directions, the edges of the two threads are adjacent at points that move during the rotation of the shaft. The electrical discharge here occurs at the intersection points of the differently or oppositely angled threads, because here the radial distance is the smallest, and due to the continuous displacement of the intersection points, point discharge is performed without wear and tear.

The edges can also be circular without a slope on at least one of the two opposing surfaces. If edges are located only on one surface, they should be on the negatively charged surface for generating a corona discharge. In general, it can be sufficient if the edges consist only of individual segments that do not extend over 360°.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Figure 1:
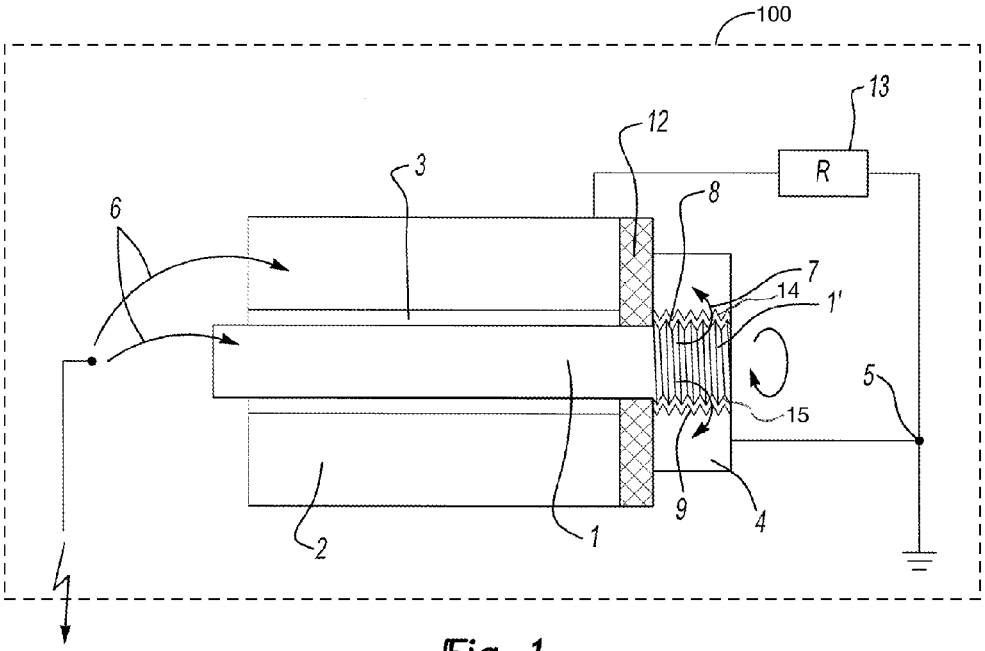
FIG. 1, a schematic axial section view of the shaft bearing with the potential neutralization arrangement, and FIG. 2, a schematic illustration of the potential neutralization arrangement according to FIG. 1.

In FIG. 1, the bearing unit of an electrostatic rotary atomizer 100 for coating a part (not shown) is illustrated, whose rotating bell-shaped plate (not shown) can be threaded in a known way into the end, is shown on the left in the drawing, of a hollow shaft 1 extending to an outer surface. The shaft 1 is supported in the housing part 2 of the bearing unit, with the air gap 3 between the shaft 1 and the cylindrical inner surface of the housing part 2 being used as an air bearing, also in a known way. The housing part 2 and the part of the shaft 1 connected to the bell-shaped plate during operation of the atomizer 100 are subjected to electrical charging through the high-voltage field generated by the electrodes of the atomizer 100, as indicated by the arrow 6.

At its end remote from the bell-shaped plate, the shaft 1 is supported in a potential neutralization housing 4 of the bearing unit which is grounded at 5, and which in turn is grounded at its side without contact. For contact-free grounding of the shaft, the end part 1' of the shaft, as shown in the illustration, is provided with a thread 15 over the part of its periphery located in the housing 4. The edges 8 of the shaft threading form peaks that are positioned opposite the edges 9 of a similarly formed internal thread 14 in the cylindrical inner surface of the housing 4. The radial distance between the edges 8 and 9 of the two threads 14, 15 is so small that electrical discharges at the degree required for the desired potential neutralization are guaranteed between them, as indicated by the arrow 7. The air gap between the cylindrical end part 1' of the shaft 1 and the cylindrical bearing surface of the housing 4 should have approximately the same size in the area of the discharge region formed by the threads 14, 15 as the air gap 3 over the remaining region of the shaft bearing.

Figure 2:
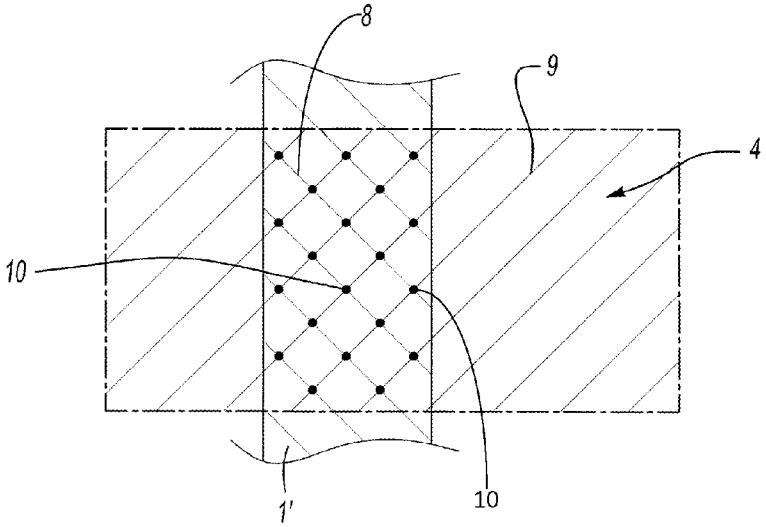

As can be seen in FIG. 2, which shows the profile of the thread 15 of the shaft end part 1' with edges 8 relative to the developed view of the cylindrical inner surface of the housing 4 with thread edges 9, the two threads 14, 15 have opposite thread directions (right-handed and left-handed threads, respectfully). Thus, because the edges 8 and 9 are not parallel, but instead intersect, this arrangement produces at the intersection points 10 point discharges similar to those for needle tips, but without the effects of erosion due to discharge at stationary points, since the intersection points 10 travel along both edge groups corresponding to the shaft rotation.

In order for the discharges to remain securely limited to the potential neutralization range formed by the threads 14, 15, it is advantageous to separate the housing part 2 from the grounded potential neutralization housing 4 by an insulating layer 12 or some other insulating device. The housing part 2 can be grounded, e.g., advantageously by a high-impedance resistor 13.

The described embodiment can be modified in various ways within the scope of the invention. One possibility, for example, is the use of a shaft that is electrically conductive only in the area between the bell-shaped plate and the nearby potential neutralization arrangement, and that is insulated over the remainder of the shaft.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein reference numerals are merely for convenience and are not to be in any way limiting, the invention may be practiced otherwise than as specifically described.

The invention claimed is:

1. A potential neutralization arrangement for an electrostatic rotary atomizer rotatable in a region of a field, comprising:

a housing defining a bearing unit having a shaft rotatably disposed therein, with a part of said bearing unit having a fixed potential, and said shaft being electrically charged by an electrode;

said shaft having an end part with a threaded surface structure defining a shaft edge and said part of said bearing unit having a fixed potential defining a threaded surface structure with a grounding edge, said threaded surface structures oriented in an opposite helical direction and said edges being radially spaced wherein an electrical charge is transferred between said shaft edge and said grounding edge thereby grounding said shaft without contact.

2. A potential neutralization arrangement as set forth in claim 1, wherein the opposite helical directions of said threaded surface structure of said shaft and said threaded surface structure of said bearing unit produce discharge points on one of said shaft and said bearing unit.

3. A potential neutralization arrangement as set forth in claim 2, wherein said discharge points provide electrical discharge between a first thread edge of said threaded surface structure of said shaft and a second thread edge of said threaded surface structure of said bearing unit.

4. A potential neutralization arrangement as set forth in claim 3, wherein at least one of the first thread edge and the second thread edge is negatively charged.

5. A potential neutralization arrangement as set forth in claim 3, wherein said shaft and said housing define an air gap therebetween generally equal to a width defined between the first thread edge and the second thread edge.

6. A potential neutralization arrangement as set forth in claim 3, wherein the first thread edge and the second thread edge form non-stationary discharge points spaced along said threaded surface structure of said shaft and said threaded surface structure of said bearing unit.

7. A potential neutralization arrangement as set forth in claim 2, including an insulating device electrically separating at least a portion of said housing from said shaft.

8. A potential neutralization arrangement as set forth in claim 2, wherein one of said housing and said shaft is grounded.

9. A rotary atomizer comprising:

a bearing unit having a bearing edge defined by a threaded inner surface; and a shaft rotatably disposed within at least a portion of the bearing unit and having a shaft edge defined by a threaded outer surface;

wherein the bearing edge and the shaft edge are oriented in opposite helical directions relative to one another and radially spaced, wherein an electrical charge is transferred between the bearing edge and the shaft edge to ground the shaft without contact.

10. The rotary atomizer of claim 9, wherein a proximity of the bearing edge to the shaft edge defines a plurality of discharge points on one of the bearing edge and the shaft edge.

11. The rotary atomizer of claim 10, wherein the electrical charge is transferred between the bearing edge and the shaft edge at the plurality of discharge points.

12. The rotary atomizer of claim 10, wherein a location along the shaft edge where the electrical charge is transferred changes as the shaft rotates relative to the bearing unit.

13. The rotary atomizer of claim 9, wherein at least one of the bearing edge and the shaft edge is negatively charged.

14. The rotary atomizer of claim 9, wherein the bearing unit and the shaft define an air gap, wherein at least a portion of the air gap has a width approximately equal to a distance between the bearing edge and the shaft edge.

15. The rotary atomizer of claim 9, wherein one of said bearing unit and said shaft is electrically grounded.

16. A rotary atomizer comprising:

a bearing unit having a bearing edge defined by a threaded inner surface, wherein the bearing edge is electrically grounded; and a shaft rotatably disposed within at least a portion of the bearing unit and having a shaft edge defined by a threaded outer surface;

wherein the bearing edge and the shaft edge are oriented in opposite helical directions relative to one another and radially spaced, wherein an electrical charge is transferred between the bearing edge and the shaft edge at a plurality of discharge points, wherein the electrical charge is transferred between the bearing edge and the shaft edge at the discharge points and wherein a location along the shaft edge where the electrical charge is transferred changes as the shaft rotates relative to the bearing unit.

17. The rotary atomizer of claim 16, wherein the bearing and the shaft define an air gap, wherein at least a portion of the air gap has a width approximately equal to a distance between the bearing edge and the thread edge.

* * * * *